US011081265B2

(12) United States Patent
Iwasa et al.

(10) Patent No.: US 11,081,265 B2
(45) **Date of Patent: *Aug. 3, 2021**

(54) RARE-EARTH SINTERED MAGNET

(71) Applicant: TDK CORPORATION, Tokyo (JP)

(72) Inventors: Takurou Iwasa, Tokyo (JP); Ryuji Hashimoto, Tokyo (JP); Masashi Ito, Tokyo (JP)

(73) Assignee: TDK CORPORATION, Tokyo (JP)

( * ) Notice: Subject to any disclaimer, the term of this patent is extended or adjusted under 35 U.S.C. 154(b) by 181 days.

This patent is subject to a terminal disclaimer.

(21) Appl. No.: 16/465,402

(22) PCT Filed: Nov. 30, 2017

(86) PCT No.: PCT/JP2017/043075

§ 371 (c)(1),
(2) Date: May 30, 2019

(87) PCT Pub. No.: WO2018/101409

PCT Pub. Date: Jun. 7, 2018

(65) Prior Publication Data

US 2020/0005973 A1 Jan. 2, 2020

(30) Foreign Application Priority Data

Nov. 30, 2016 (JP) ..... JP2016-232112
Mar. 21, 2017 (JP) ..... JP2017-054942

(51) Int. Cl.

| | |
|---|---|
| ***H01F 1/055*** | (2006.01) |
| ***C22C 33/02*** | (2006.01) |
| ***C22C 38/00*** | (2006.01) |
| ***C22C 38/10*** | (2006.01) |
| ***H01F 1/053*** | (2006.01) |

(52) U.S. Cl.

CPC ..... *H01F 1/0557* (2013.01); *C22C 33/02* (2013.01); *C22C 38/005* (2013.01); *C22C 38/10* (2013.01); *H01F 1/0536* (2013.01); *C22C 2202/02* (2013.01)

(58) Field of Classification Search

CPC ..... H01F 1/0557; H01F 1/0536; C22C 33/02; C22C 38/005; C22C 38/10; C22C 2202/02; C22C 38/00

See application file for complete search history.

(56) References Cited

U.S. PATENT DOCUMENTS

| | | | | |
|---|---|---|---|---|
| 10,886,044 | B2 * | 1/2021 | Ito | C22C 38/005 |
| 2016/0163434 | A1 * | 6/2016 | Kanada | C22C 38/005 310/156.08 |
| 2016/0276075 | A1 * | 9/2016 | Ito | H01F 1/058 |
| 2019/0333660 | A1 * | 10/2019 | Ito | C22C 33/02 |
| 2020/0020468 | A1 * | 1/2020 | Hashimoto | C22C 33/02 |

FOREIGN PATENT DOCUMENTS

JP 2008-133496 A 6/2008

OTHER PUBLICATIONS

Saito et al.; "High coercivity Sm—Fe melt-spun ribbon;" Journal of Applied Physics; 105; 07A716; 2009; pp. 1-3.

Saito et al.; "Magnetic properties of Sm5Fe17-based magnets produced by spark plasma sintering method;" IOP Conf Series: Materials Science and Engineering 1; IOP Publishing; 2009; pp. 1-6.

* cited by examiner

*Primary Examiner* — Anthony J Zimmer
*Assistant Examiner* — Jacob J Gusewelle
(74) *Attorney, Agent, or Firm* — Oliff PLC

(57) ABSTRACT

A rare-earth sintered magnet contains main phase crystal grains having an Nd5Fe17-type crystal structure, includes R and T (where R represents one or more rare-earth elements that essentially include Sm and T represents Fe or one or more transition metal elements that essentially include Fe and Co), and wherein the compositional ratio of R is 20-40 at % and the remaining portion is substantially T; the remaining portion other than R is substantially only T or only T and C; and when the main phase crystal grains' average grain size in one cross-sectional surface of the rare-earth sintered magnet is defined as Dv, while grain size of individual main phase crystal grains is defined as Di, Dv is at least 1.0 μm, and the main phase crystal grains' area ratio that satisfy $0.7Dv \leq Di \leq 2.0Dv$ is at least 80% with respect to the area of a cross-sectional surface of the rare-earth sintered magnet.

4 Claims, No Drawings

RARE-EARTH SINTERED MAGNET

BACKGROUND OF THE INVENTION

The present invention relates to a rare-earth sintered magnet including a compound having an $Nd_5Fe_{17}$ type crystal structure as a main phase.

A rare-earth permanent magnet such as an Nd—Fe—B magnet and a Sm—Co magnet is widely used for various motors, various actuators, various MRI devices, and the like due to high magnetic properties; and annual production volume of rare-earth permanent magnet is increasing every year.

Since a rare-earth permanent magnet such as mentioned in above having an intermetallic compound as a main phase has been developed, research of permanent magnets has been mainly focused on trying to find a new intermetallic compound of rare-earth metals. Among these, a permanent magnet material described in Patent Document 1 having a $Sm_5Fe_{17}$ intermetallic compound as a main phase attains extremely high coercivity of 36.8 kOe at room temperature. Therefore, the permanent magnet material described in Patent Document 1 having the $Sm_5Fe_{17}$ intermetallic compound as a main phase is considered as a promising permanent magnet material. However, a rare-earth sintered magnet having a $Sm_5Fe_{17}$ intermetallic compound as a main phase and attaining high properties is still not realized.

Non-Patent Document 1 report changes in coercivity relative to a heat treatment temperature of $Sm_5Fe_{17}$ melt-spun ribbons produced by melt spinning. In this report, although there is a difference depending on a material composition, when a heat treatment temperature is 800 K or higher and 1100 K or lower, coercivity (HcJ) of 30 kOe or higher can be obtained. However, when a heat treatment temperature is higher than 1100 K, it is reported that HcJ significantly decreases because a $Sm_5Fe_{17}$ phase decomposes. In order to increase a residual magnetization, preferably a sintering step is carried out after a molding step in a magnetic field. However, according to Non-Patent Document 1, when the permanent magnet material having the $Sm_5Fe_{17}$ intermetallic compound as a main phase is subjected to a heat treatment at high temperature for sintering, the $Sm_5Fe_{17}$ phase as a main phase of the permanent magnet material having the $Sm_5Fe_{17}$ intermetallic compound as a main phase decomposes, hence the magnetic properties significantly decreased.

Non-Patent Document 2 reports a sintered magnet of which $Sm_5Fe_{17}$ melt-spun ribbons produced by melt spinning is sintered using Spark Plasma Sintering (SPS) method. However, the produced magnet is not oriented and is isotropic, thus a residual magnetization is about 45 emu/g which is low. Also, a relative density is only about 91% or so.

[Patent Document 1] JP Patent Application Laid Open No. 2008-133496

[Non-Patent Document 1] Journal of Applied Physics 105 07A716(2009)

[Non-Patent Document 2] Materials Science and Engineering 1 (2009)012032

BRIEF SUMMARY OF THE INVENTION

The present invention is attained in view of such circumstances, and the object is to provide a rare-earth sintered magnet having good magnetic properties.

In order to attain the above object, the present inventors have carried out earnest examinations of a compound having an $Nd_5Fe_{17}$ type crystal structure. As a result, the present inventors have found that by controlling an average grain size and grain size distribution of main phase crystal grains, a degree of orientation of the main phase crystal grains improve and a high residual magnetic flux density can be obtained. Further, it was found that by controlling an average grain size and grain size distribution of main phase crystal grains, the main phase having an $Nd_5Fe_{17}$ type crystal structure can be prevented from decomposing, and high coercivity can be obtained. Note that, the $Nd_5Fe_{17}$ type crystal structure refers to a same type of crystal structure as a crystal structure of $Nd_5Fe_{17}$ intermetallic compound. Also, R is not necessarily limited to Nd and T is not necessarily limited to Fe.

The rare-earth sintered magnet according to the present invention is a rare-earth sintered magnet having main phase crystal grains having $Nd_5Fe_{17}$ type crystal structure, wherein the rare-earth sintered magnet has R and T (R is essentially Sm or is at least one selected from rare earth elements in addition to Sm; and T is essentially Fe or a combination of Fe and Co or is at least one selected from transition metal elements in addition to Fe or the combination of Fe and Co), a compositional ratio of R in the rare-earth sintered magnet is 20 at % or more and 40 at % or less, a remaining part besides R in the rare-earth sintered magnet is substantially T only or a combination of T and C only, and Dv is 1.0 μm or more and an area ratio of the main phase crystal grains satisfying $0.7Dv \leq Di \leq 2.0Dv$ is 80% or more in a cross section of the rare-earth sintered magnet in which Dv represents an average grain size of the main phase crystal grains and Di represents a grain size of individual main phase crystal grains at the cross section of the rare-earth sintered magnet.

When controlling the average grain size and grain size distribution of the main phase crystal grains of the rare-earth sintered magnet, it is important to control an average particle size and particle size distribution of a raw material powder. When the particle size distribution of the raw material powder is not controlled, finely pulverized particles and coarsely pulverized particles are mixed in the raw material powder. When the finely pulverized particles and the coarsely pulverized particles are mixed, rotation of the particles to align an orientation axis during a molding step in a magnetic field is interfered, and an orientation is disturbed. Then, as the orientation is disturbed, the degree of orientation decreases, and the residual magnetic flux density of the rare-earth sintered magnet obtained at the end decreases. Therefore, in case the finely pulverized particles and the coarsely pulverized particles are mixed in the raw material powder, this could cause the residual magnetic flux density of the rare-earth sintered magnet obtained at the end to decrease. Further, as the finely pulverized particles which sinter at a relatively low temperature and the coarsely pulverized particles which sinter at a higher temperature than the finely pulverized particle are mixed, if a sintering temperature is low, ununiformity of sintering tends to form partially, and a density of a sintered body may decrease. Also, if a sintering temperature is high, an $R_5T_{17}$ phase which is a metastable phase tends to decompose easily, and a main phase decreases due to the decomposition of the $R_5T_{17}$ phase and different phases increase, thus this could cause decrease of the magnetic properties. By controlling the average particle size and particle size distribution of the raw material powder, and controlling a molding and sintering condition depending on the average particle size and particle size distribution of the raw material powder, the average grain size and grain size distribution of the main phase crystal grains of the rare-earth sintered magnet can be set within the range of the present invention. Thereby, the rare-earth sintered magnet having good magnetic properties can be obtained. Note that, by using a raw material of finely pulverized powder, the average grain size of the main phase crystal grains can be made even smaller. However, in case of using the raw material of finely pulverized powder, grain growth of the main phase crystal grains during the sintering step tends to be ununiform easily, and it is substantially difficult to have the average grain size and grain size distribution of the main phase crystal grains within the predetermined range.

The rare-earth sintered magnet of the present invention may further have C, and C content is more than 0 at % and 15.0 at % or less.

In the rare-earth sintered magnet of the present invention, a ratio of Sm in entire R is 50 at % or more and 99 at % or less, and a ratio of total of Pr and Nd in entire R is 1 at % or more and 50 at % or less.

According to the present invention, the rare-earth sintered magnet having good magnetic properties can be provided by controlling the average grain size and grain size distribution of the main phase crystal grains.

DETAILED DESCRIPTION OF THE INVENTION

Hereinafter, embodiments for carrying out the present invention are described in detail. Note that, the present invention is not to be limited to a context described below embodiments. A constituting element of the below described embodiments includes those one ordinary skilled in the art can easily attain, those substantially the same, and those which are in so called equivalent range. Further, the constituting element described below embodiments can be combined accordingly.

The rare-earth sintered magnet according to the present embodiment is described. The rare-earth sintered magnet according to the present embodiment is a rare-earth sintered magnet includes main phase crystal grains having $Nd_5Fe_{17}$ type crystal structure, wherein the rare-earth sintered magnet includes R and T (R is essentially Sm or is at least one selected from rare earth elements in addition to Sm; and T is essentially Fe or a combination of Fe and Co or is at least one selected from transition metal elements in addition to Fe or the combination of Fe and Co), a compositional ratio of R in the rare-earth sintered magnet is 20 at % or more and 40 at % or less, a remaining part besides R in the rare-earth sintered magnet is substantially T only or a combination of T and C only, and Dv is 1.0 μm or more and an area ratio of the main phase crystal grains satisfying $0.7Dv \leq Di \leq 2.0Dv$ is 80% or more in a cross section of the rare-earth sintered magnet in which Dv represents an average grain size of the main phase crystal grains and Di represents a grain size of individual main phase crystal grains at the cross section of the rare-earth sintered magnet.

The main phase crystal grains are constituted from a compound having an $Nd_5Fe_{17}$ type crystal structure (a space group $P6_3/mcm$). As long as the main phase crystal grains include R-T as a main component, other solid solution element and the like may be included. Hereinafter, a phase having an $Nd_5Fe_{17}$ type crystal structure is described as an $R_5T_{17}$ phase.

The main phase crystal grains included in the rare-earth sintered magnet according to the present embodiment are constituted preferably by a single-phase of the $R_5T_{17}$ phase. However, other phases such as an $RT_2$ phase, an $RT_3$ phase, an $R_2T_{17}$ phase, an $RT_5$ phase, an $RT_7$ phase, an $R_2T_{17}$ phase, an $RT_{12}$ phase, and the like may be included in the main phase crystal grains.

A volume ratio of the $R_5T_{17}$ phase as a main phase in the entire permanent magnet is 50% or more, and preferably 75% or more. The larger the volume ratio of the $R_5T_{17}$ phase is, the larger the residual magnetic flux density of the rare-earth sintered magnet is.

R is essentially Sin or is at least one selected from rare earth elements in addition to Sin. Here, the rare-earth elements are Sm, Y, La, Pr, Ce, Nd, Eu, Gd, Tb, Dy, Ho, Er, Tm, Yb, and Lu. A ratio of Sm in the entire rare-earth elements of the entire rare-earth sintered magnet is preferably 50 at % or more.

R content in the rare-earth sintered magnet according to the present embodiment is 20 at % or more and 40 at % or less. In case R content is less than 20 at %, the $R_5T_{17}$ phase included in the main phase crystal grains of the rare-earth sintered magnet is not formed sufficiently, and the residual magnetic flux density and the coercivity decrease. On the other hand, if R content exceeds 40 at %, the ratio of $R_5T_{17}$ phase included in the rare-earth sintered magnet decreases, thus the residual magnetic flux density and the coercivity decrease.

Preferably, a ratio of Sm in the entire R is 50 at % or more and 99 at % or less, and a ratio of total of Pr and Nd in the entire R is 1 at % or more and 50 at % or less. In case Pr and/or Nd are included 1 at % or more in total, the residual magnetization improves compared to the case of having a total content of Pr and/or Nd of less than 1 at %. This is because magnetic moments of $Nd^{3+}$ and $Pr^{3+}$ are larger than a magnetic moment of $Sm^{3+}$. Note that, when a ratio of total of Pr and Nd is larger than 50 at %, a crystal magnetic anisotropy and the coercivity decrease compared to the case of having a ratio of total of Pr and Nd of 1 at % or more and 50 at % or less. This is because Stevens factor of $Nd^{3+}$ and $Pr^{3+}$ are smaller than that of $Sm^{3+}$. When a ratio of total of Pr and Nd is larger than 50 at %, a ratio of an $R_2T_{17}$ phase having in-plane anisotropy increases. When the $R_2T_{17}$ phase increases, this causes to form a kink near zero magnetic field of a demagnetization field.

T is essentially Fe or a combination of Fe and Co or is at least one element selected from transition metal elements in addition to Fe or the combination of Fe and Co. T may be Fe alone, or part of Fe may be substituted by Co. In case part of Fe is substituted by Co, Co content in the entire transition metal element is preferably 20 at % or less with respect to the entire rare-earth sintered magnet. By selecting appropriate Co amount, a saturation magnetic flux density and a corrosion resistance can be improved.

In the rare-earth sintered magnet according to the present embodiment, when Dv represents the average grain size of the main phase crystal grains and Di represents a grain size of individual main phase crystal grains at one cross section of the rare-earth sintered magnet, Dv is 1.0 μm or more, and an area ratio of main phase crystal grains satisfying $0.7Dv \leq Di \leq 2.0Dv$ is 80% or more with respect to an area of the cross section of the rare-earth sintered magnet. By having the average grain size and grain size distribution of the rare-earth sintered magnet within the above mentioned range, the degree of orientation of the main phase crystal grains can be improved and also a sintered density can be increased, and a high residual magnetic flux density can be obtained. Also, by preventing decomposition of the $R_5T_{17}$ phase as the main phase, high coercivity can be attained. When the average grain size Dv of the main phase crystal grains is less than 1.0 μm, the grain size distribution of the main phase crystal grains deteriorates, and the magnetic properties decrease. The average grain size and grain size distribution of the main phase crystal grains can be controlled by a classifying condition and a pulverization method during a fine pulverization step, or by a sintering condition, and the like.

In the present embodiment, by analyzing the cross section of the rare-earth sintered magnet using a method of image processing and the like, the grain size of the main phase crystal grains can be obtained. Specifically, an area of a cross section of each main phase crystal grain in a cross section of the rare-earth sintered magnet is obtained by image analysis, and a diameter of circle having an area equal to the main phase crystal grain in the cross section (circle equivalent diameter) is defined as a grain size of the main phase crystal grain at the cross section. Further, for all of the main phase crystal grains existing in an observation field to be analyzed in the cross section, a grain size is obtained. Here, Di represents the grain size of individual main phase crystal grains, and Dv is average grain size of the main phase crystal grains of the rare-earth sintered magnet defined by arithmetic mean of (sum of grain size of all main phase crystal grains)/(total number of the main phase crystal grains). To calculate an area ratio of the main phase crystal grains satisfying $0.7Dv \leq Di \leq 2.0Dv$ with respect to an area of the cross section of the rare-earth sintered magnet, first a total area of entire main phase crystal grains which satisfy $0.7Dv \leq Di \leq 2.0Dv$ determined by above method is calculated by an image processing software, then this total area is divided by the area of the cross section of the rare-earth sintered magnet. Note that, in case of an anisotropic magnet, a cross section which is parallel to an easy axis of magnetization of the rare-earth sintered magnet is used for an analysis. Also, a shape of the observation field to be analyzed is a square or a rectangle of (40 μm to 100 μm)×(40 μm to 100 μm).

C content in the rare-earth sintered magnet according to the present embodiment is preferably more than 0 at % and 15 at % or less. By having appropriate amount of C content, atomic distance between T-T can be widened, and an exchange interaction between T-T can be stronger. When C content is more than 15 at %, a ratio of the obtained $R_5T_{17}$ phase decreases and the magnetic properties tend to decrease.

Also, the rare-earth sintered magnet according to the present embodiment may include elements other than C. As the elements other than C, at least one element selected from the group consisting of N, H, Be, and P can be used. Further, the rare-earth sintered magnet according to the present embodiment may include other elements. For example, elements such as Bi, Sn, Ga, Si, Ge, Zn, and the like can be included accordingly. Also, the rare-earth sintered magnet may include impurities derived from a raw material. A content of these elements is specifically 5 at % or less in total, and it is about the amount so that the remaining part other than R in the rare-earth sintered magnet can be considered T only or a combination of T and C only.

<Method of Producing Rare-Earth Sintered Magnet>

An example of a method of producing the rare-earth sintered magnet according to the present embodiment is described. The method of producing the rare-earth sintered magnet according to the present embodiment includes a preparation step of preparing a raw material alloy, a pulverization step of obtaining a finely pulverized powder by pulverizing the raw material alloy, a molding step producing a green compact by molding the finely pulverized powder, and a sintering step obtaining a sintered body by sintering the green compact.

The preparation step is a step of preparing the raw material alloy having all elements included in the rare-earth sintered magnet according to the present embodiment. Note that, the present embodiment describes the method of producing in which the raw material alloy is prepared by a strip casting method. However, the raw material alloy may be prepared by other methods, specifically a super rapid solidification method, a vapor deposition method, and the like may be used to prepare the raw material alloy.

First, raw material metals having predetermined elements are prepared, and a strip casting method is carried out using these. Thereby, the raw material alloy can be prepared. The raw material metals including Sm and Fe are prepared, and the raw material alloy is prepared and casted so that the rare-earth sintered magnet having a predetermined composition can be obtained.

The pulverization step is a step of obtaining a finely pulverized powder by pulverizing the raw material alloy obtained by the preparation step. This step is preferably carried out in two-steps, that is a coarse pulverization step and a fine pulverization step, but it may be done in one-step. For example, the coarse pulverization step can be carried out using a stamp mill, a jaw crusher, a brown mill, and the like, in inert gas atmosphere. The coarse pulverization step is carried out until the particle size of the raw material alloy becomes several hundred μm to several mm or so to obtain the coarsely pulverized powder.

Also, in order to attain high magnetic properties, each step from the pulverization step to the sintering step is preferably carried out under atmosphere of low oxygen concentration. The oxygen concentration may be regulated by controlling the atmosphere of each production step. When the oxygen concentration of each production step is high, the rare-earth element R in the alloy powder is oxidized and R oxides are generated. Due to generation of R oxides, the volume ratio of the main phase included in the rare-earth sintered magnet decreases. The residual magnetic flux density of the obtained rare-earth sintered magnet decreases due to decrease of the volume ratio of the main phase. Thus, for example, the oxygen concentration of each production step is preferably 100 ppm or less.

The fine pulverization step is a step of preparing a finely pulverized powder having an average particle size of several μm or so by finely pulverizing the coarsely pulverized powder obtained by the coarse pulverization step. The average particle size of the finely pulverized powder may be determined by considering a degree of growth of crystal grains during sintering. The fine pulverization can be carried out for example by a jet mill, a beads mill, and the like.

In case of obtaining the finely pulverized powder by finely pulverizing using a jet mill, since a particle size of the finely pulverized powder is small and the finely pulverized powder surface being pulverized is extremely active, the finely pulverized powder easily re-aggregate with each other or easily adheres to a chamber wall, thus a yield tends to decrease. Thus, when finely pulverizing the coarsely pulverized powder of the alloy, a pulverization aid such as zinc stearate, oleic amide, and the like is added to prevent re-aggregation of the powder with each other and adhesion to the chamber wall, thereby a high yield of the finely pulverized powder can be attained. An amount of pulverization aid added differs depending on the particle size of the finely pulverized powder and a type of the pulverization aid added, however it is preferably about 0.1 mass % or more and 1 mass % or less.

As a fine pulverization method other than a dry pulverization method using a jet mill and the like, a wet pulverization method may be mentioned. For a wet pulverization method, a beads mill is preferably used which stirs at a high speed using small size beads. Also, a multistep pulverization may be performed in which a wet pulverization using a beads mill is further carried out after a dry pulverization using a jet mill.

In case of using a jet mill, a jet mill attached with a classifier is preferable, and by using a fine pulverizer attached with a classifier, the coarsely pulverized particles and ultra finely pulverized particles can be removed and re-pulverized, thus the grain size distribution of the main phase crystal grains of the rare-earth sintered magnet can be controlled.

The molding step is a step of molding the finely pulverized powder in a magnetic field to produce a green compact. Specifically, the finely pulverized powder is filled in a press mold between electromagnets, and then while applying a magnetic field by the electromagnets to orient a crystal axis of the finely pulverized powder, the pressure is applied to the finely pulverized powder and thereby the molding is carried out. This molding in the magnetic field may be carried out for example by applying a magnetic field of 1000 kA/m or more and 1600 kA/m or less, and applying a pressure of 30 MPa or more and 300 MPa or less or so.

The sintering step is a step of sintering the green compact to obtain the sintered body. In order to control the average grain size and grain size distribution of the main phase crystal grains of the rare-earth sintered magnet, it is important to produce the sintered body while maintaining the particle size distribution of the finely pulverized powder obtained by the pulverization step. In case of carrying out sintering by SPS method, preferably a sintering holding temperature is higher than 500° C. and less than 700° C. and a sintering holding time is 3 minutes or longer and 10 minutes or shorter. By setting the sintering holding temperature within the above range and having a short sintering holding time as mentioned in above, a grain growth of the main phase crystal grains is suppressed and the grain size distribution can be controlled, and the rare-earth sintered magnet having high magnetic properties can be obtained. When the sintering holding temperature is 500° C. or lower, density of the magnet is not sufficient and the residual magnetic flux density tends to decrease. When the sintering holding temperature is 700° C. or higher, excessive particle growth of the finely pulverized powder is promoted and the grain size distribution of the sintered body deteriorates, further the $R_5T_{17}$ phase partially decomposes thus the residual magnetic flux density and the coercivity tend to decrease. It is necessary to regulate the sintering holding temperature and the sintering holding time depending on various conditions such as the raw material alloy composition, the pulverization method, the variation of average grain size and grain size distribution, the sintering method, and the like.

According to the method described hereinabove, the rare-earth sintered magnet can be obtained, but the method of production of the rare-earth sintered magnet of the present embodiment is not to be limited thereto and may be modified variously.

EXAMPLES

Next, the present invention is described in further detail based on examples; however, the present invention is not to be limited to following examples.

Experiments 1 to 9

First, raw materials of a rare-earth sintered magnet were prepared, and a raw material alloy was prepared and casted by a strip casting method so to obtain the rare-earth sintered magnet having a composition shown in Table 1.

TABLE 1

| | Sm (at %) | Fe (at %) |
|---|---|---|
| Compsition A | 23.2 | 76.8 |
| Compsition B | 25.6 | 74.4 |
| Compsition C | 27.0 | 73.0 |

Next, the obtained raw material alloy was subjected to a hydrogen pulverization treatment, in which a hydrogen storage was carried out at 400° C., and then a dehydrogenation was carried out for 1 hour under Ar atmosphere at 500° C. Then, the raw material alloy was cooled to room temperature under Ar atmosphere, and a coarsely pulverized powder was obtained.

Then, 0.5 mass % of oleic amide as a pulverization aid was added to the obtained coarsely pulverized powder and mixed; and a fine pulverization was carried out using a jet mill to obtain a finely pulverized powder. Also, in this fine pulverization step, the particle size of the finely pulverized powder was controlled by changing a classifier condition of a jet mill. For Experiments 1 to 3, the finely pulverized powder was produced so that an average grain size Dv of the main phase crystal grains of the rare-earth sintered magnet was within the range of 0.8 μm or more and 0.9 μm or less. Similarly, for Experiments 4 to 6, an average grain size Dv of the main phase crystal grains of the rare-earth sintered magnet was within the range of 1.0 μm or more and 1.1 μm or less; and for Experiments 7 to 9, an average grain size Dv of the main phase crystal grains of the rare-earth sintered magnet was within the range of 2.9 μm or more and 3.0 μm or less.

The obtained finely pulverized powder was subjected to molding in a magnetic field, and sintered at a sintering holding temperature of 620° C. for a sintering holding time of 5 minutes using SPS method.

Experiments 10 to 15

Raw materials were blended so to obtain the rare-earth sintered magnet having a composition shown in Table 1, and as similar to Experiment 1, a raw material alloy was prepared, casted, and a hydrogen pulverization treatment was carried out.

To the above coarsely pulverized powder obtained by a hydrogen pulverization treatment, 0.2 mass % of oleic amide was added and then mixed. Then, the fine pulverization was carried out by a jet mill until the particle size D50 was 4.0 μm. The finely pulverized powder by a jet mill was subjected to a multistep pulverization to further carry out fine pulverization using a beads mill. For a fine pulverization using a beads mill, a pulverized particle size of the finely pulverized powder was controlled by changing a pulverization time of a beads mill. For Experiments 10 to 12, a fine pulverization was carried out so that the average grain size Dv of the main phase crystal grains of the rare-earth sintered magnet was within a range of 1.0 μm or more and 1.1 μm or less; and for Experiments 13 to 15, a fine pulverization was carried out so that the average grain size Dv of the main phase crystal grains of the rare-earth sintered magnet was within a range of 2.9 μm or more and 3.0 μm or less. After the fine pulverization using a beads mill, drying was carried out in inert gas for 10 hours or longer to 24 hours or shorter.

The obtained finely pulverized powder was subjected to molding in a magnetic field as similar to Experiment 1, and the rare-earth sintered magnets of Experiments 10 to 15 were obtained.

Microstructures and magnetic properties of the rare-earth sintered magnets of Experiments 1 to 15 were evaluated. As for the evaluation of microstructures, specifically, the average grain size Dv of the main phase crystal grains of a cross section of the rare-earth sintered magnet, and the area ratio of the main phase crystal grains satisfying 0.7Dv≤Di≤2.0Dv in the cross section of the rare-earth sintered magnet were obtained. As for the evaluation of magnetic properties, the residual magnetic flux density Br and the coercivity HcJ of the rare-earth sintered magnet were measured.

For the rare-earth sintered magnets of Experiments 1 to 15, the average grain size Dv of the main phase crystal grains was evaluated. A cross section of a sample was polished and observed using SEM, then the average grain size Dv of the main phase crystal grains was calculated using image analysis software. Further, the area ratio of the main phase crystal grains satisfying 0.7Dv≤Di≤2.0Dv in the cross section of the rare-earth sintered magnet was calculated using image analysis software as similar to the average grain size Dv of the main phase crystal grains. The average grain size Dv of the main phase crystal grains and the area ratio of the main phase crystal grains satisfying 0.7Dv≤Di≤2.0Dv in the cross section of the rare-earth sintered magnet are shown in Table 2. Note that, a shape of a field of observation carried out with SEM observation was square of 50 m×50 μm.

For the rare-earth sintered magnets of Experiments 1 to 15, a compositional analysis was carried out by Inductively coupled plasma—mass spectroscopy method (ICP-MS method). As a result, it was confirmed that the composition of each rare-earth sintered magnet approximately matched a target composition (composition shown in Table 1). Also, generated phases were analyzed using X ray diffraction (XRD) method. As a result, it was confirmed that in each rare-earth sintered magnet, an $R_5T_{17}$ phase was a main phase.

The magnetic properties of the rare-earth sintered magnets of Experiments 1 to 15 were measured using a B-H tracer. The measurement results of Br and HcJ of each rare-earth sintered magnet are shown in Table 2. Note that, in Table 2, "Dry method" means that a dry pulverization was only carried out and a wet pulverization was not done, and "Wet method" means that a multistep pulverization in which a wet pulverization was carried out after a dry pulverization.

TABLE 2

| | Composition | Pulverization | Dv (μm) | Area ratio (%) of main phase crystal grains satisfying 0.7Dv ≤ Di ≤ 2.0Dv | Br (kG) | HcJ (kOe) | |
|---|---|---|---|---|---|---|---|
| Experiment 1 | A | Dry method | 0.85 | 74.7 | 6.7 | 20.3 | Comparative example |
| Experiment 2 | B | Dry method | 0.88 | 77.0 | 6.5 | 19.4 | Comparative example |
| Experiment 3 | C | Dry method | 0.83 | 75.2 | 6.1 | 18.5 | Comparative example |
| Experiment 4 | A | Dry method | 1.04 | 84.1 | 8.6 | 38.2 | Example |
| Experiment 5 | B | Dry method | 1.09 | 88.2 | 8.2 | 35.5 | Example |
| Experiment 6 | C | Dry method | 1.07 | 85.2 | 7.7 | 32.2 | Example |
| Experiment 7 | A | Dry method | 2.95 | 87.0 | 9.1 | 30.2 | Example |
| Experiment 8 | B | Dry method | 2.98 | 88.4 | 8.6 | 28.8 | Example |
| Experiment 9 | C | Dry method | 2.95 | 87.2 | 8.2 | 26.7 | Example |
| Experiment 10 | A | Wet method | 1.09 | 72.3 | 6.5 | 19.8 | Comparative example |
| Experiment 11 | B | Wet method | 1.05 | 70.4 | 6.3 | 18.3 | Comparative example |
| Experiment 12 | C | Wet method | 1.07 | 73.2 | 5.8 | 17.8 | Comparative example |
| Experiment 13 | A | Wet method | 2.96 | 80.8 | 8.9 | 29.7 | Example |
| Experiment 14 | B | Wet method | 2.94 | 81.4 | 8.3 | 27.2 | Example |
| Experiment 15 | C | Wet method | 2.98 | 81.8 | 8.0 | 26.2 | Example |

For Experiments 1 to 3, the average grain size Dv of the main phase crystal grains was less than 1.0 μm, both Br and HcJ decreased. Also, the area ratio of the main phase crystal grains satisfying 0.7Dv≤Di≤2.0Dv was less than 80%. It was confirmed that magnetic properties having good Br and HcJ were obtained in Experiments 4 to 9 and Experiments 13 to 15 in which the average grain size Dv of the main phase crystal grains was 1.0 μm or larger and the area ratio of the main phase crystal grains satisfying 0.7Dv≤Di≤2.0Dv was 80% or more.

When a wet pulverization and a dry pulverization were compared, Experiments 10 to 15 which were produced using a wet pulverization had a smaller area ratio of the main phase crystal grains satisfying 0.7Dv≤Di≤2.0Dv compared to Experiments 4 to 9 which were produced using a dry pulverization only. As a reason for this, it is speculated that in a wet pulverization, particles are pulverized by breaking from edges, thus ultra-finely pulverized particles and relatively coarsely pulverized particles exist beside the particles having target particle size in the finely pulverized particles after the pulverization, and then the ultra-finely pulverized particles and the relatively coarsely pulverized particles appear to have influenced the grain size distribution of the main phase crystal grains after sintering. For Experiments 10 to 12, the average grain size Dv of the main phase crystal grains was 1.0 μm or larger and the area ratio of the main phase crystal grains satisfying 0.7Dv≤Di≤2.0Dv was less than 80%, and Br and HcJ both decreased as similar to Experiments 1 to 3.

Experiments 16 to 21

Raw materials of the rare-earth sintered magnet were blended, and a raw material alloy was prepared so to obtain the rare-earth sintered magnet having a composition shown in Table 3. The raw material alloy was casted, pulverized, molded, and sintered as similar to Experiment 1; thereby the rare-earth sintered magnets of Experiments 16 to 18 shown in Table 4 were obtained. Also, for each composition shown in Table 3, the raw material alloy was casted, pulverized, molded, and sintered as similar to Experiment 4; thereby the rare-earth sintered magnets of Experiments 19 to 21 were obtained.

TABLE 3

| | Sm (at %) | Fe (at %) | C (at %) |
|---|---|---|---|
| Compsition D | 23.9 | 69.9 | 6.2 |
| Compsition E | 23.1 | 62.6 | 14.3 |
| Compsition F | 20.8 | 63.8 | 15.4 |

For the rare-earth sintered magnets of Experiments 16 to 21, a compositional analysis was carried out by ICP-MS method and a combustion in oxygen stream-infrared absorption method. As a result, it was confirmed that each rare-earth sintered magnet approximately matched a target composition (compositions shown in Table 3). Also, generated phases were analyzed using XRD method. As a result, it was confirmed that in each rare-earth sintered magnet, an $R_5T_{17}$ phase was a main phase.

As similar to Experiments 1 to 15, microstructures and magnetic properties of the obtained rare-earth sintered magnets obtained by Experiments 16 to 21 were evaluated. Results are shown in Table 4.

TABLE 4

| | Composition | Pulverization | Dv (μm) | Area ratio (%) of main phase crystal grains satisfying 0.7Dv ≤ Di ≤ 2.0Dv | Br (kG) | HcJ (kOe) | |
|---|---|---|---|---|---|---|---|
| Experiment 16 | D | Dry method | 0.84 | 73.2 | 6.4 | 20.9 | Comparative example |
| Experiment 17 | E | Dry method | 0.81 | 73.1 | 8.1 | 20.1 | Comparative example |
| Experiment 18 | F | Dry method | 0.80 | 71.2 | 5.6 | 16.4 | Comparative example |
| Experiment 19 | D | Dry method | 1.10 | 85.9 | 8.0 | 39.1 | Example |
| Experiment 20 | E | Dry method | 1.12 | 84.2 | 7.6 | 32.8 | Example |
| Experiment 21 | F | Dry method | 1.09 | 81.2 | 7.1 | 24.6 | Example |

For Experiments 16 to 18, the average grain size Dv of the main phase crystal grains was less than 1.0 μm and both Br and HcJ decreased. Also, the area ratio of the main phase crystal grains satisfying 0.7Dv≤Di≤2.0Dv was less than 80%. It was confirmed that magnetic properties having good Br and HcJ were obtained in Experiments 19 to 21 in which the average grain size Dv of the main phase crystal grains was 1.0 μm or larger and the area ratio of the main phase crystal grains satisfying 0.7Dv≤Di≤0.2.0Dv was 80% or more.

Experiment 19 had better HcJ than Experiment 4 having approximately same ratio of Sm and Fe. It is speculated that this is caused because exchange interaction between T-T was stronger as appropriate amount of C formed solid solution. Experiment 20 had better HcJ than Experiment 6 having approximately same ratio of Sm and Fe. On the other hand, Experiment 21 had decreased HcJ and residual magnetization compared to Experiments 19 and 20. It is speculated that this was caused because C amount was large and the ratio of an $R_5T_{17}$ phase decreased. That is, in case C amount is larger than 0 at % and 15 at % or less, better magnetic properties can be obtained.

Experiments 22 to 25

Raw materials of the rare-earth sintered magnet were blended so to obtain the rare-earth sintered magnet having a composition shown in Table 5. A raw material alloy was casted, pulverized, molded, and sintered as similar to Experiment 4; thereby the rare-earth sintered magnets of Experiments 22 to 25 shown in Table 6 were obtained.

TABLE 5

| | Sm (at %) | Fe (at %) |
|---|---|---|
| Compsition G | 19.2 | 80.8 |
| Compsition H | 20.8 | 79.2 |
| Compsition I | 39.2 | 60.8 |
| Compsition J | 40.8 | 59.2 |

For the rare-earth sintered magnets of Experiments 22 to 25, a compositional analysis was carried out by ICP-MS method. As a result, it was confirmed that the composition of each rare-earth sintered magnet approximately matched a target composition (compositions shown in Table 5). Also, generated phases were analyzed using XRD method. As a result, it was confirmed that in each rare-earth sintered magnet, an $R_5T_{17}$ phase was a main phase.

As similar to Experiment 4, microstructures and magnetic properties of the rare-earth sintered magnets obtained by Experiments 22 to 25 were evaluated. Results are shown in Table 6.

TABLE 6

| | Composition | Pulverization | Dv (μm) | Area ratio (%) of main phase crystal grains satisfying 0.7Dv ≤ Di ≤ 2.0Dv | Br (kG) | HcJ (kOe) | |
|---|---|---|---|---|---|---|---|
| Experiment 22 | G | Dry method | 1.04 | 85.3 | 2.2 | 3.1 | Comparative example |
| Experiment 23 | H | Dry method | 1.05 | 87.1 | 7.8 | 19.4 | Example |
| Experiment 24 | I | Dry method | 1.03 | 83.2 | 7.1 | 18.5 | Example |
| Experiment 25 | J | Dry method | 1.05 | 86.6 | 2.5 | 1.4 | Comparative example |

For Experiment 22 having R content of less than 20 at % and Experiment 25 having R content of more than 40 at %, even though the average grain size of the main phase crystal grains was 1.0 μm or more and the area ratio of the main phase crystal grains satisfying 0.7Dv≤Di≤2.0Dv was 80% or more, Br and HcJ decreased. For Experiments 23 and 24 in which R content was 20 at % or more and 40 at % or less, good Br and HcJ were obtained.

Experiments α to σ

Raw materials of the rare-earth sintered magnet were blended and a raw material alloy was prepared so to obtain the rare-earth sintered magnet having a composition shown in Table 7. The raw material alloy was casted, pulverized, molded, and sintered as similar to Experiment 1; thereby the rare-earth sintered magnets of Experiments α to ι shown in Table 8 were obtained. Also, the raw material alloy was casted, pulverized, molded, and sintered as similar to Experiment 4; thereby the rare-earth sintered magnets of Experiments κ to σ shown in Table 8 were obtained.

TABLE 7

| | Sm (at %) | Pr (at %) | Nd (at %) | Ce (at %) | Fe (at %) |
|---|---|---|---|---|---|
| Composition P | 24.6 | 1.1 | — | — | 74.3 |
| Composition Q | 19.4 | 6.4 | — | — | 74.2 |
| Composition R | 13.1 | 12.7 | — | — | 74.2 |
| Composition S | 12.7 | 13.1 | — | — | 74.2 |
| Composition T | 19.0 | 5.6 | — | 1.2 | 74.2 |
| Composition U | 24.7 | — | 1.1 | — | 74.2 |
| Composition V | 19.3 | — | 6.5 | — | 74.2 |
| Composition W | 13.7 | — | 12.0 | — | 74.3 |
| Composition X | 12.7 | — | 13.2 | — | 74.1 |

TABLE 8

| | Composition | Pulverization | Dv (μm) | Area ratio (%) of main phase crystal grains satisfying 0.7Dv ≤ Di ≤ 2.0Dv | Br (kG) | HcJ (kOe) | |
|---|---|---|---|---|---|---|---|
| Experiment α | P | Dry method | 0.86 | 76.9 | 8.5 | 19.2 | Comparative example |
| Experiment ß | Q | Dry method | 0.84 | 72.7 | 6.5 | 17.2 | Comparative example |
| Experiment γ | R | Dry method | 0.83 | 76.8 | 6.8 | 17.1 | Comparative example |
| Experiment δ | S | Dry method | 0.82 | 76.9 | 6.8 | 15.2 | Comparative example |
| Experiment ε | T | Dry method | 0.82 | 78.9 | 6.5 | 17.0 | Comparative example |
| Experiment ζ | U | Dry method | 0.87 | 75.3 | 6.8 | 19.1 | Comparative example |
| Experiment η | V | Dry method | 0.87 | 75.2 | 6.6 | 16.8 | Comparative example |
| Experiment θ | W | Dry method | 0.84 | 74.3 | 6.6 | 16.9 | Comparative example |
| Experiment ι | X | Dry method | 0.86 | 73.9 | 6.7 | 16.2 | Comparative example |
| Experiment κ | P | Dry method | 1.09 | 86.4 | 8.4 | 35.0 | Example |
| Experiment λ | Q | Dry method | 1.08 | 84.1 | 8.8 | 32.8 | Example |
| Experiment μ | R | Dry method | 1.07 | 83.1 | 9.3 | 24.5 | Example |
| Experiment ν | S | Dry method | 1.05 | 82.1 | 8.5 | 22.1 | Example |
| Experiment ξ | T | Dry method | 1.05 | 82.1 | 8.8 | 32.1 | Example |
| Experiment ○ | U | Dry method | 1.08 | 86.3 | 8.4 | 34.7 | Example |
| Experiment π | V | Dry method | 1.10 | 85.6 | 8.8 | 32.5 | Example |
| Experiment ρ | W | Dry method | 1.06 | 84.1 | 8.2 | 24.3 | Example |
| Experiment σ | X | Dry method | 1.04 | 81.9 | 8.4 | 21.9 | Example |

For the rare-earth sintered magnets of Experiments α to σ, a compositional analysis was carried out by ICP-MS method. As a result, it was confirmed that each rare-earth sintered magnet approximately matched a target composition (compositions shown in Table 7). Also, generated phases were analyzed using XRD method. As a result, it was confirmed that in each rare-earth sintered magnet, an $R_5T_{17}$ phase was a main phase.

For Experiments α to ι having the average grain size Dv of the main phase crystal grains of less than 1.0 μm, Br and HcJ both decreased. Also, the area ratio of the main phase crystal grains satisfying 0.7Dv≤Di≤2.0Dv was less than 80%. It was confirmed that good magnetic properties having good Br and HcJ were obtained for Experiments κ to σ in which the average grain size Dv of the main phase crystal grains was 1.0 μm or larger and the area ratio of the main phase crystal grains satisfying 0.7Dv≤Di≤2.0Dv was 80% or more.

Experiments κ, λ, and μ had better Br compared to Experiment 5 having about the same ratio of R and Fe. As Pr and Nd were substituted in an appropriate amount for Sm, it is speculated that a magnetic moment was increased. However, HcJ decreased than Experiment 5. It is thought that because Pr and Nd were substituted for Sm, the crystal magnetic anisotropy decreased. Also, in Experiment ξ, Pr and Ce were substituted for Sm. When compared with Experiment λ, about the same residual magnetization and HcJ were able to obtain. Good magnetic properties were obtained even when substitution was carried out by other rare earth elements. Experiments σ, π, and ρ also had increased Br compared to Experiment 5. On the other hand, Experiments μ and π had decreased Br compared to Experiment 5. It is considered that this is caused because a total substitution amount of Pr and Nd for Sm exceeded 50 at %, $R_2T_{17}$ phase having in-plane anisotropy was easily formed, and a kink near zero magnetic field was generated in a demagnetization curve.

Experiments κ to χ

Raw materials of the rare-earth sintered magnet were blended and a raw material alloy was prepared so to obtain the rare-earth sintered magnet having a composition shown in Table 9. The raw material alloy was casted, pulverized, molded, and sintered as similar to Experiment 1; thereby the rare-earth sintered magnets of Experiments τ to υ shown in Table 10 were obtained. Also, the raw material alloy was casted, pulverized, molded, and sintered as similar to Experiment 4; thereby the rare-earth sintered magnets of Experiments ϕ to χ shown in Table 10 were obtained.

TABLE 9

| | Sm (at %) | Pr (at %) | Fe (at %) | C (at %) |
|---|---|---|---|---|
| Composition Y | 18.8 | 6.3 | 73.1 | 1.8 |
| Composition Z | 18.2 | 5.9 | 69.9 | 6.0 |

TABLE 10

| | Composition | Pulverization | Dv (μm) | Area ratio (%) of main phase crystal grains satisfying 0.7Dv ≤ Di ≤ 2.0Dv | Br (kG) | HcJ (kOe) | |
|---|---|---|---|---|---|---|---|
| Experiment τ | Y | Dry method | 0.85 | 76.9 | 6.5 | 19.5 | Comparative example |
| Experiment υ | Z | Dry method | 0.84 | 73.2 | 6.4 | 20.3 | Comparative example |
| Experiment ϕ | Y | Dry method | 1.11 | 85.2 | 8.8 | 33.1 | Example |
| Experiment χ | Z | Dry method | 1.12 | 85.9 | 8.7 | 34.0 | Example |

For the rare-earth sintered magnets of Experiments τ to χ, a compositional analysis was carried out by ICP-MS method and a combustion in oxygen stream-infrared absorption method. As a result, it was confirmed that the composition of each rare-earth sintered magnet approximately matched a target composition (compositions shown in Table 9). Also, generated phases were analyzed using XRD method. As a result, it was confirmed that in each rare-earth sintered magnet, an $R_5T_{17}$ phase was a main phase.

For Experiments τ to υ having the average grain size Dv of the main phase crystal grains of less than 1.0 μm, both Br and HcJ decreased. Also, the area ratio of the main phase crystal grains satisfying 0.7Dv≤Di≤2.0Dv was less than 80%. It was confirmed that good magnetic properties having good Br and HcJ were obtained in Experiments ϕ to χ in which the average grain size Dv of the main phase crystal grains was 1.0 μm or larger and the area ratio of the main phase crystal grains satisfying 0.7Dv≤Di≤2.0Dv was 80% or more.

Experiments ϕ and χ had better HcJ compared to Experiment λ in which a ratio of R amount and Fe amount and a ratio of Sm amount and Pr amount were about the same. By forming a solid solution of appropriate amount of C, it is considered that exchange interaction between T-T became stronger.

Hereinabove, the present invention was described based on embodiments to carry out the present invention. The embodiments are examples and can be variously changed and modified within the scope of the present claims, and one ordinary skilled in the art would understand that such change and modification are deemed within the scope of the present invention. Therefore, descriptions and figures in the present specification should be considered as an example and should not be limited thereto.

INDUSTRIAL APPLICABILITY

According to the present invention, by controlling an average grain size and grain size distribution of main phase crystal grains, a rare-earth sintered magnet having good magnetic properties can be provided.

What is claimed is:

1. A rare-earth sintered magnet comprising main phase crystal grains having $Nd_5Fe_{17}$ crystal structure, wherein the rare-earth sintered magnet comprises R and T (R is Sm or is at least one element selected from rare earth elements in addition to Sm; and T is Fe or a combination of Fe and Co or is at least one element selected from transition metal elements in addition to Fe or the combination of Fe and Co), a compositional ratio of R in the rare-earth sintered magnet is 20 at % or more and 40 at % or less, a remaining part besides R in the rare-earth sintered magnet is substantially T only or a combination of T and C only, and Dv is 1.0 μm or more and an area ratio of the main phase crystal grains satisfying $0.7Dv \leq Di \leq 2.0Dv$ is 80% or more in a cross section of the rare-earth sintered magnet in which Dv represents an average grain size of the main phase crystal grains and Di represents a grain size of individual main phase crystal grains at the cross section of the rare-earth sintered magnet.

2. The rare-earth sintered magnet according to claim 1 further including C, and C content is more than 0 at % and 15.0 at % or less.

3. The rare-earth sintered magnet according to claim 1, wherein a ratio of Sm in entire R is 50 at % or more and 99 at % or less, and a ratio of total of Pr and Nd in entire R is 1 at % or more and 50 at % or less.

4. The rare-earth sintered magnet according to claim 2, wherein a ratio of Sm in entire R is 50 at % or more and 99 at % or less, and a ratio of total of Pr and Nd in entire R is 1 at % or more and 50 at % or less.

* * * * *